United States Patent [19]

Hisatsune et al.

[11] Patent Number: 4,885,441

[45] Date of Patent: Dec. 5, 1989

[54] CIRCUIT BREAKER

[75] Inventors: Fumiyuki Hisatsune; Shinji Yamagata, both of Fukuyama, Japan

[73] Assignee: Mitsubishi Denki Kabushiki Kaisha, Tokyo, Japan

[21] Appl. No.: 201,415

[22] Filed: Sep. 15, 1987

[30] Foreign Application Priority Data

Sep. 16, 1986 [JP] Japan ..... 61-141915[U]
Sep. 16, 1986 [JP] Japan ..... 61-218594[U]
Sep. 16, 1986 [JP] Japan ..... 61-218595[U]

[51] Int. Cl.[4] ..... H01H 33/02
[52] U.S. Cl. ..... 200/144 R; 200/147 R
[58] Field of Search ..... 200/144 R, 147 R

[56] References Cited

U.S. PATENT DOCUMENTS 4,086,460 4/1978 Gillette ..... 200/144 R
4,409,444 10/1983 Yoshiyasu et al. ..... 200/144 R
4,409,445 10/1983 Yoshiyasu et al. ..... 200/144 R
4,429,198 1/1984 Mori et al. ..... 200/144 R
4,453,053 6/1984 Yamagata et al. ..... 200/144 R
4,511,774 4/1985 Forsell ..... 200/147 R
4,642,428 2/1987 Yoshiyasu et al. ..... 200/147 R

FOREIGN PATENT DOCUMENTS 1062316 7/1959 Fed. Rep. of Germany .
176999 11/1971 Fed. Rep. of Germany .
4940765 4/1976 Japan .
57-140043 9/1982 Japan .
57-140047 9/1982 Japan .

*Primary Examiner*—Robert S. Macon
*Attorney, Agent, or Firm*—Lowe, Price, LeBlanc, Becker & Shur

[57] ABSTRACT

A circuit breaker with arc-extinguishing structure comprises a protrusion (5*b*) formed on an arc running surface (5*a*) of arc-runner (5) for smoothly moving an arc, and thus the arc is quickly extinguished.

14 Claims, 10 Drawing Sheets

CIRCUIT BREAKER

FIELD OF THE INVENTION AND RELATED ART STATEMENT

1. FIELD OF THE INVENTION

The present invention relates generally to an improvement in a circuit breaker, and, more particularly, to an improvement in a structure for arc extinguishing.

2. DESCRIPTION OF THE RELATED ART

FIG. 1 shows a structure of the region of contacts and grids of a known circuit breaker. A fixed 4 and an arc runner 5 are fixed on a fixed arm 3 by brazing. The fixed arm 3 is fixed to a base 6 of insulating material by a screw 12 or the like, and a folded tip 31 of the fixed arm 3 is also fixed by the screw 12. A movable contact 2 is provided on a movable arm 1. The movable contact 2 and the fixed contact 4 are made to contact each other in closing state.

When an overcurrent flows, a releasing device (not shown) releases the movable arm 1 and thus the movable contact 2 is disconnected from the fixed contact 4. At this time, an arc 9 occurs between the movable contact 2 and the fixed contact 4. The arc 9 moves on the arc-runner 5 in a direction shown by arrow A in FIG. 1 and FIG. 2 (which shows a plan view of grids 10), and is led into narrow notch part 10*a*. The moved arc is broken up into a smaller fractional arcs and is thus cooled by plural grids 10 of magnetic plates spaced part between a pair of insulating frame 11.

As shown in FIG. 2, in such a conventional circuit breaker, there is a fear that the arc may stay in a point 9*a* (of FIG. 2) which is not in the notch part 10*a*, by thermionic emission from the grid 10 when the arc does not move smoothly into the notch part 10*a*, and stays at the point 9*a*. Further, when the arc does not move smoothly into the notch part, another arc is often generated between the contacts 2 and 4. Therefore, the cutoff characteristic of the conventional circuit breaker is not satisfactory.

OBJECT AND SUMMARY OF THE INVENTION

It is an object of the present invention to provide a circuit breaker having a superior cutoff characteristic.

A circuit breaker in accordance with the present invention comprises, a fixed arm, a fixed contact provided on the fixed arm, a movable arm to be driven by a releasing device, a movable contact provided on the movable arm and being connectable and disconnectable to the fixed contact by operation of the movable arm, an arc extinguishing grid one end of which has notch for guiding an arc therein, an arc guiding plate one end of which is fixed to the fixed arm, having an arc running surface on which a protrusion is provided.

While the novel features of the invention are set forth particularly in the appended claims, the invention, both as to organization and content, will be better understood and appreciated, along with other objects and features thereof, from the following detailed description taken in conjunction with the drawings.

DESCRIPTION OF THE PREFERRED EMBODIMENTS

Figure 1:
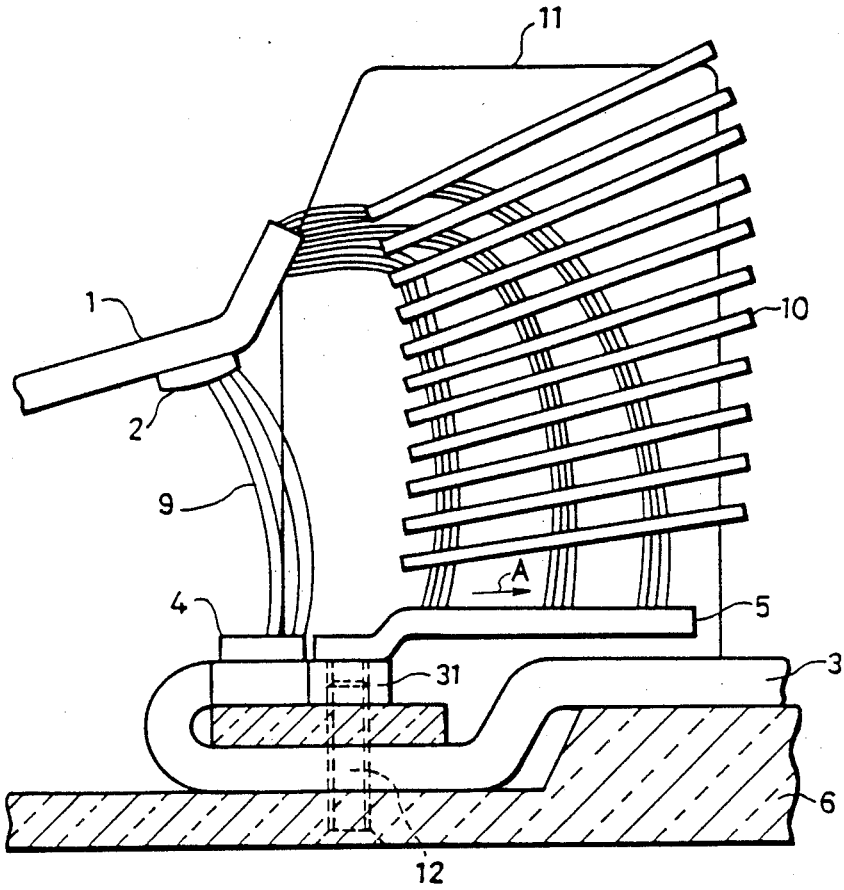
FIG.1 (Prior Art)
FIG. 1 is the sectional view of the circuit breaker of the prior art.
Figure 2:
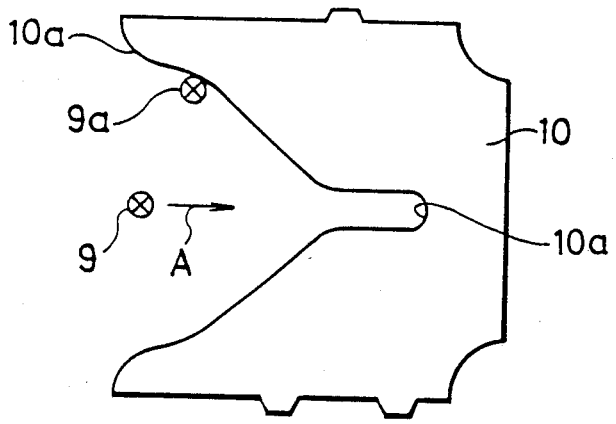
FIG.2 (Prior Art)
FIG. 2 is the plane view of the grid 10 of the circuit breaker of FIG. 1.
Figure 3:
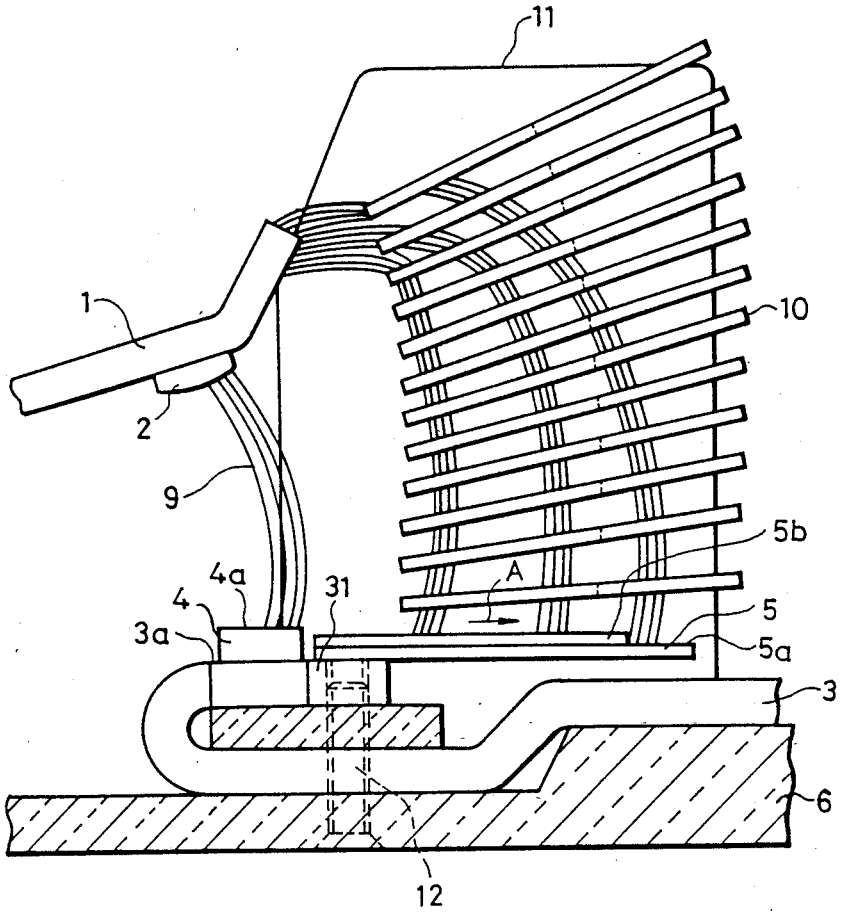
FIG. 3 is a sectional view of a circuit breaker embodying the present invention.

FIG. 3 is a cross sectional view of a circuit breaker of a first embodiment of the present invention showing a structure of the region of contacts and grids. A fixed contact 4 and an arc runner 5 as an arc guiding plate are fixed to a fixed arm 3 having folded tip 31, by brazing. The fixed arm 3 is fixed to a base 6 of insulating material by a screw 12 or the like and a folded tip 31 of a fixed arm 3 is also fixed by the screw 12. A movable contact 2 is provided on a movable arm 1.

On the arc-runner 5, a protrusion 5*b* is provided. An upper surface of the protrusion 5*b* is made lower than a contact surface 4*a* of the fixed contact 4. Therefore, the movable arm 1 does not contact the protrusion 5*b* even when the fixed contact 4 is worn.

Grid 10, formed of magnetic plates provided spaced apart from each other between a pair of insulating frame 11, is provided in the upper space over the arc-runner 5.

Figure 4:
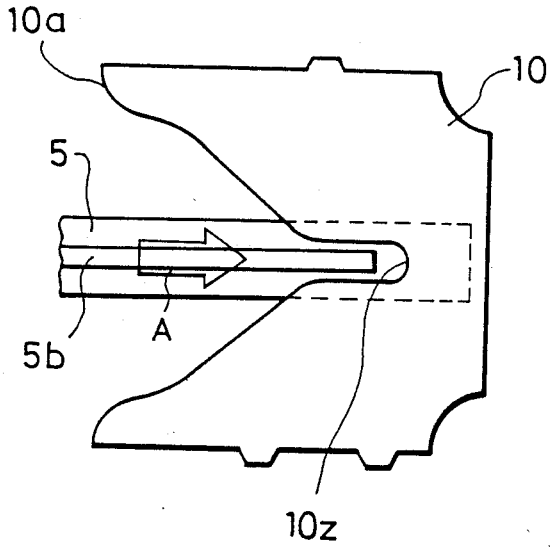
FIG. 4 is a plane view of the grid 10 of the cricuit breaker of FIG. 3.
Figure 5A:
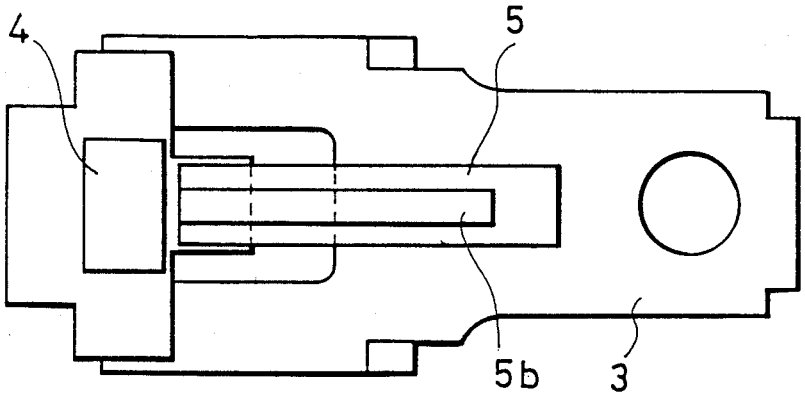
FIG. 5A is a plane view of a fixed arm 3, a fixed contact 4 and an arc-runner 5 in a second embodiment of the present invention.
Figure 5B:
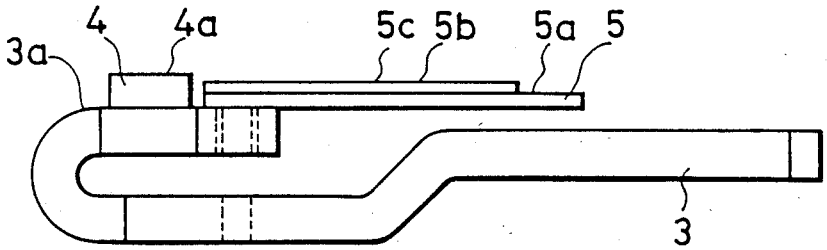
FIG. 5B is a side view of the apparatus of FIG. 5A.

FIG. 5A is a plan view of the region including the arc-runner as used in the circuit breaker of FIG. 3, and FIG. 5B is a side view of the part of FIG. 5A. The protrusion 5*b* is provided in the center part of the arc running surface 5*a* of the arc-runner 5. A relation of position between the protrusion 5*b* and a notch 10*a* of the grid 10 is shown in the plane view of FIG. 4. As shown in FIG. 4, the protrusion 5*b* does not reach an inner end 10*z* of the notch 10*a*.

Referring to FIG. 3, the operation of the circuit breaker is described hereafter. In its closing state, the movable contact 2 and the fixed contact 4 thereof are made contact to each other.

When an overcurrent flows, a releasing device (not shown) releases the movable arm 1 and thus the movable contact 2 is disconnected from the fixed contact 4. At this time, an arc 9 occurs between the movable contact 2 and the fixed contact 4. The arc 9 moves on the arc-runner 5 in a direction shown by an arrows A in FIG. 3 and FIG. 4. The protrusion 5*b* provided on the arc running surface 5*a* of the arc-runner concentrates the electric field. Therefore, the arc 9 moves smoothly along the protrusion 5*b*. Because the arc 9 moves on the center part of the arc running surface 5*a*, the arc 9 does not contact a side part 10*a* of the notch 10*a*. Therefore there is no fear that the arc stays in the side part of the notch 10*a*. Further, because the protrusion 5*b* does not reach the inner end 10*z* of the notch 10*a*, the arc is effectively extended to be bent in an arc-shape as shown by numeral 9*e* in FIG. 3, and the arc extinguishing is carried out smoothly.

Figure 6A:
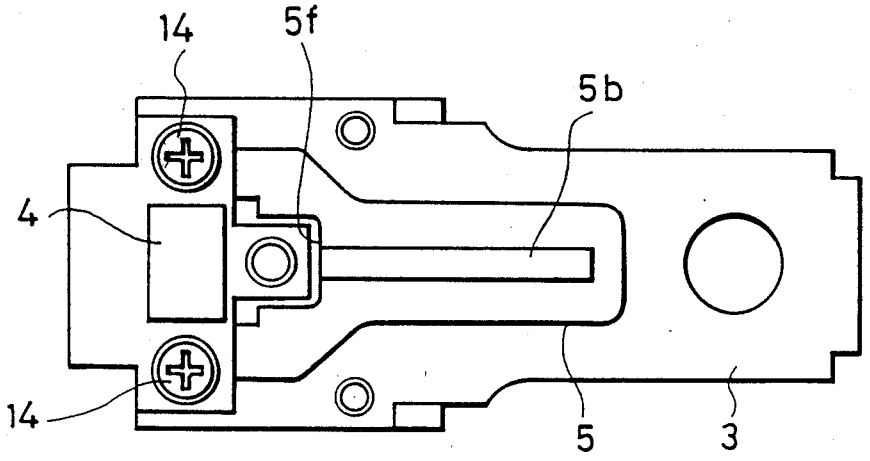
FIG. 6A is a plane view of a fixed arm 3, a fixed contact 4 and an arc-runner 5 in a third embodiment of the present invention.
Figure 6B:
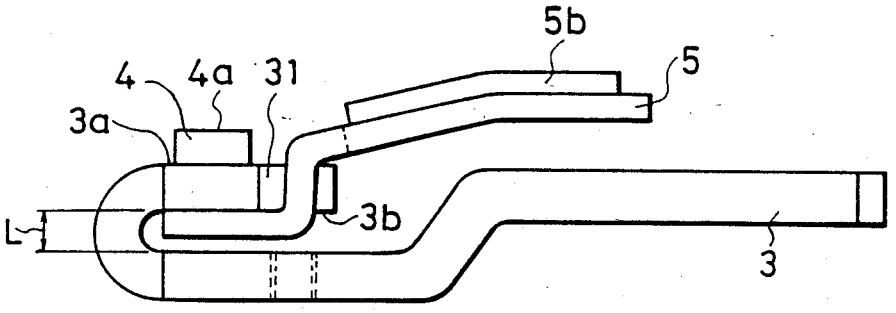
FIG. 6B is a side view of the apparatus of FIG. 6A.

FIG. 6A is a plan view of the part including the arc-runner used in the circuit breaker of a third embodiment of the present invention, and FIG. 6B is a side view of the part of FIG. 6A. The fixed contact 4 and the arc runner 5 are fixed on the fixed arm 3 which has folded tip 31, by brazing. An inner gap size L of the folded part, is selected layer than the thickness of the arc-runner 5, and to a folded inner surface 3b the arc-runner 5 is fixed by the screw 14 (not shown). In the arc-runner 5, a hole 5*f* is provided for avoiding undesirable touch between a tip 31 of the fixed arm 3 and the arc-runner 5. By providing the notch 5*f*, the movable arm 1 does not touch the arc-runner 5 even after wearing of the fixed contact 4. The upper surface 5*c* of the protrusion 5*b* is selected higher than the contact surface 4*a* of the fixed contact 4 for lowering the arc resistance on the protrusion 5*b* than the contact surface 4*a*. Therefore, the arc moves easily from the fixed contact to the arc-runner 5.

Figure 7:
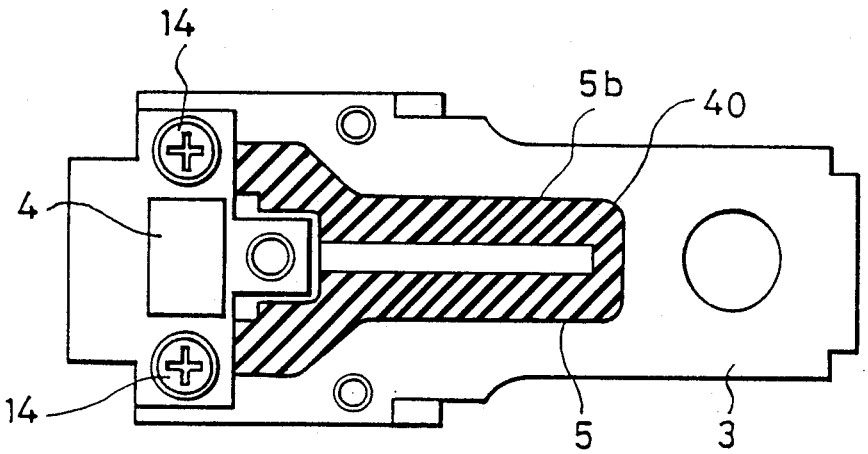
FIG. 7 is a plane view of a fixed arm 3, a fixed contact 4 and an arc-runner 5 in a fourth embodiment of the present invention.

FIG. 7 is a plan view of a part including an arc-runner used in a circuit breaker of a fourth embodiment of the present invention. In this embodiment, the arc running surface of the arc-runner 5 is covered with insulating material 40 except the protrusion 5*b*. By providing the insulating material 40, the arc runs on the protrusion 5*b* more easily and the arc is quickly extinguished. The arc runner 5 may be made by a insulating material 40 fixing which the protrusion 5*b* of a metallic material thereto, or may be made by a metallic material having the protrusion 5 with an insulating material 40 applied except the protrusion 5*b*.

Figure 8A:
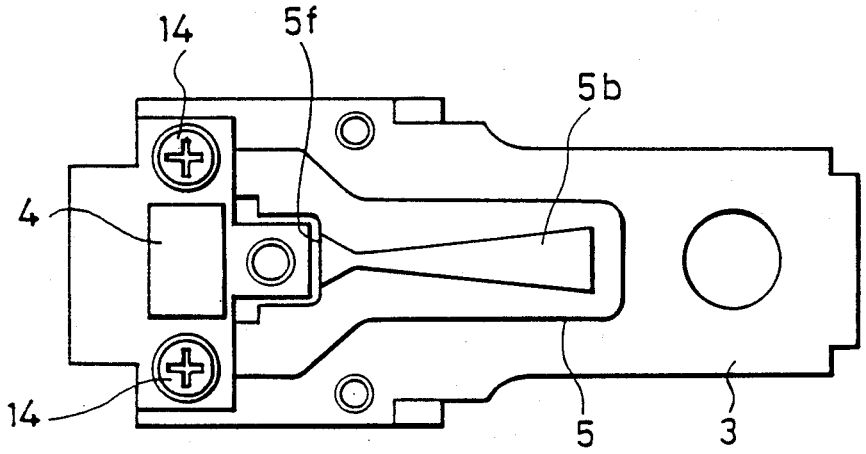
FIG. 8A is a plane view of a fixed arm 3, a fixed contact 4 and a arc-runner 5 in a fifth embodiment of the present invention.
Figure 8B:
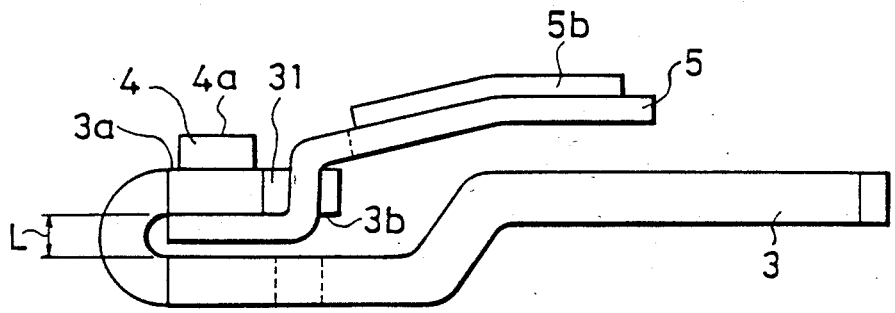
FIG. 8B is a side view of the apparatus of FIG. 8A.

FIG. 8A is a plan view of a part including an arc-runner used in the circuit breaker of a fifth embodiment of the present invention, and FIG. 8B is a side view of the apparatus of FIG. 8A. A triangular shaped protrusion 5*b* is provided on the center part of the arc running surface 5*a* of the arc-runner 5. The protrusion 5*b* is formed in manner that its contact side 5*x* is narrower than its tip side 5*y*.

In this embodiment, because the protrusion 5*b* is formed wider in the tip side 5*y*, the arc spot spreads to its natural shape and is stabilized near the tip side 5*y*. Therefore, the arc does not return to between the contacts 2 and 4.

Figure 9A:
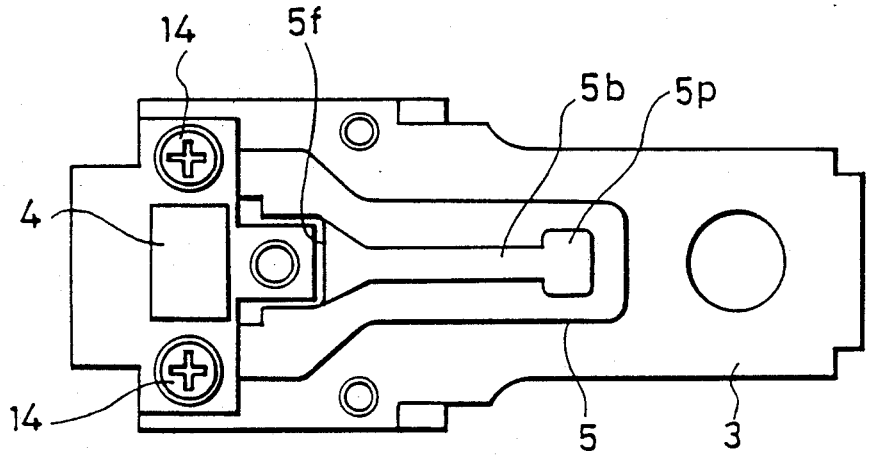
FIG. 9A is a plane view of a fixed arm 3, a fixed contact 4 and an arc-runner 5 in a sixth embodiment of the present invention.
Figure 9B:
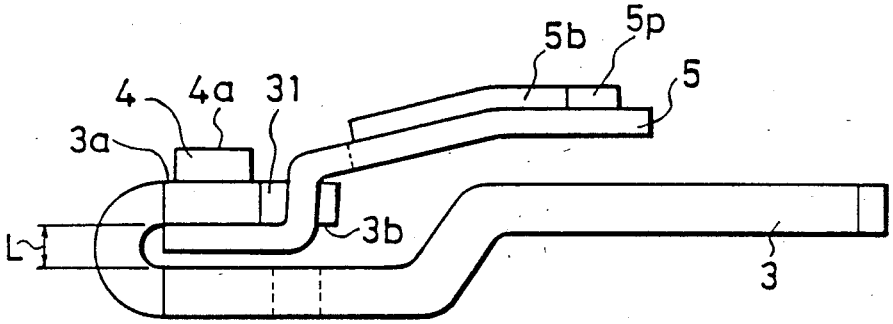
FIG. 9B is a side view of the apparatus of FIG. 9A.

FIG. 9A is a plan view of a part including an arc-runner used in the circuit breaker of a sixth embodiment of the present invention, and FIG. 9B is a side view of the apparatus of FIG. 9A. In this embodiment, a spot pool 5*p* is provided in the tip of the protrusion 5*b*. The area of the spot pool 5*p* is made slightly smaller than area of an arc spot which is formed in a condition of making constant electric current density corresponding to the rated breaking current. It is also made slightly smaller than an area of fixed contact 4. In this embodiment, because the spot pool 5*p* is provided on the tip of protrusion 5*b*, the arc spot is stabilized at the end tip of the part the pool 5*p*. Therefore, the arc neither returns to nor is reproduced between the contacts 2 and 4.

Figure 10A:
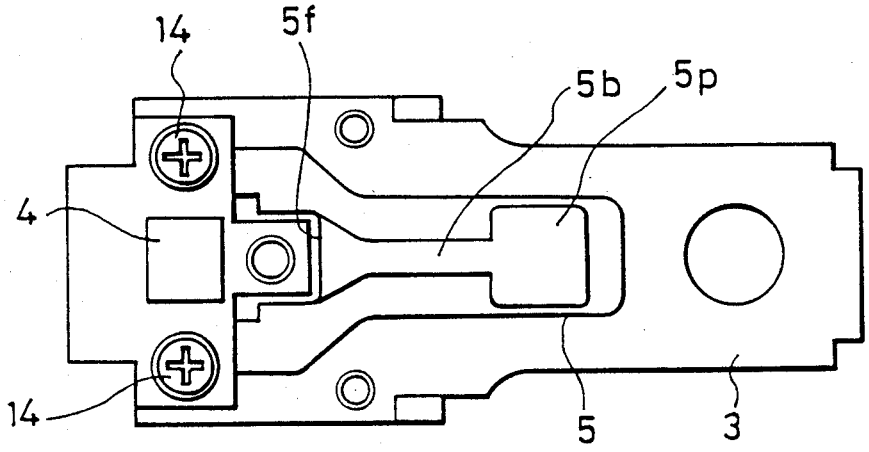
FIG. 10A is a plane view of a fixed arm 3, a fixed contact 4 and an arc-runner 5 in a seventh embodiment of the present invention.
Figure 10B:
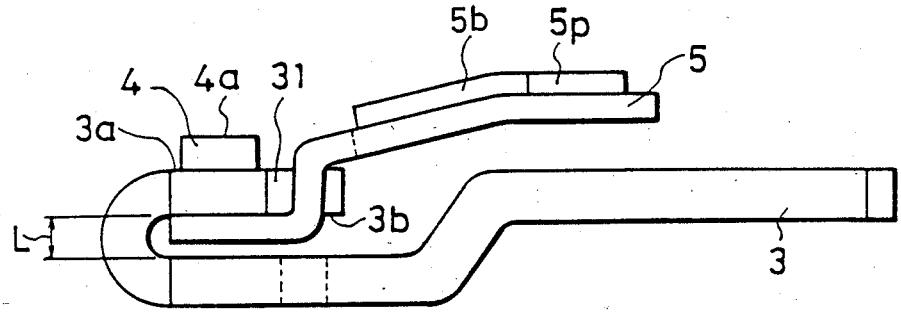
FIG. 10B is a side view of the apparatus of FIG. 10A.

FIG. 10A is a plan view of a part including an arc-runner used in the circuit breaker of a seventh embodiment of the present invention, and FIG. 10B is a side view of the apparatus of FIG. 10A. In this embodiment, a spot pool 5*p* is provided in the tip part of the protrusion 5*b*. The area of the pool 5*p* is made bigger than the area of fixed contact 4. In this embodiment, because the spot pool 5*p* is provided in the tip of protrusion 5*b* and area of the pool 5*p* is bigger than that of the contact 4 the arc is more stabilized on the pool 5*p* than on the contact. Therefore, the arc is not reproduced between the contacts 2 and 4 nor does it return thereto.

As has been described in detail for various embodiments, according to the present invention a circuit breaker of superior braking characteristic can be provided by providing a protrusion 5*b* of selected form on the arc-runner 5.

Although the invention has been described in its preferred form with a certain degree of particularity, it is understood that the present disclosure of the preferred form may be changed in the details of construction and the combination and arrangement of parts may be rearranged to without departing from the spirit and the scope of the invention as hereinafter claimed.

What is claimed is

1. A circuit breaker comprising:

a fixed arm;

a fixed contact provided on said fixed arm;

a movable arm adapted to be moved by actuation of a releasing device;

a movable contact provided on said movable arm, disposed to be connectable and disconnectable to said fixed contact by operation of said movable arm;

an arc extinguishing grid one end of which has a notch, formed to have a wide open end and a narrower closed end, for guiding therein an arc generated by a disconnection between said movable and fixed contacts; and an arc guiding plate, one end of which is fixed to said fixed arm, having an arc running surface on which a protrusion is provided, wherein said protrusion has a height that is lower than a contact surface of said fixed contact relative to said arc guiding plate and terminates short of said closed end of said notch.

2. A circuit breaker in accordance with claim 1, wherein:

said protrusion is formed to have a tip side and a contact side in such a manner that said tip side is wider than said contact side.

3. A circuit breaker in accordance with claim 1, wherein:

said protrusion is formed in a manner so as to have a spot pool at said tip side thereof.

4. A circuit breaker in accordance with claim 1, wherein:

said arc guiding plate is brazed to a folded outer surface of said fixed arm.

5. A circuit breaker in accordance with claim, wherein:

an upper surface of said arc guiding plate, except for said protrusion, is covered with insulating material.

6. A circuit breaker in accordance with claim 2, wherein:

said protrusion is formed in a manner so as to have a spot pool at said tip side thereof.

7. A circuit breaker in accordance with claim 2, wherein:

said arc guiding plate is brazed to a folded outer surface of said fixed arm.

8. A circuit breaker in accordance with claim 6, wherein:

said arc guiding plate is brazed to a folded outer surface of said fixed arm.

9. A circuit breaker in accordance with claim 2, wherein:

an upper surface of said arc guiding plate, except for said protrusion, is covered with insulating material.

10. A circuit breaker in accordance with claim 9, wherein:

said protrusion is formed in a manner so as to have a spot pool at said tip side thereof.

11. A circuit breaker in accordance with claim 10, wherein:

an upper surface of said arc guiding plate, except for said protrusion, is covered with insulating material.

12. A circuit breaker in accordance with claim 4, wherein:

an upper surface of said arc guiding plate, except for said protrusion, is covered with insulating material.

13. A circuit breaker in accordance with claim 12, wherein:

said protrusion is formed in a manner so as to have a spot pool at said tip side thereof.

14. A circuit breaker in accordance with claim 9, wherein:

said arc guiding plate is brazed to a folded outer surface of said fixed arm.

* * * * *